US007070020B2

(12) United States Patent
Preston

(10) Patent No.: US 7,070,020 B2
(45) Date of Patent: Jul. 4, 2006

(54) PARTLY RETRACTABLE CONSTRUCTION PLATFORM

(76) Inventor: John Clement Preston, 196 Silverwater Road, Silverwater, New South Wales 2141 (AU)

( * ) Notice: Subject to any disclaimer, the term of this patent is extended or adjusted under 35 U.S.C. 154(b) by 640 days.

(21) Appl. No.: 10/273,813

(22) Filed: Oct. 17, 2002

(65) Prior Publication Data

US 2003/0079940 A1 May 1, 2003

Related U.S. Application Data

(62) Division of application No. 09/423,952, filed as application No. PCT/AU98/00359 on May 15, 1998, now abandoned.

(51) Int. Cl.
*E04G 3/00* (2006.01)

(52) U.S. Cl. ..... 182/82

(58) Field of Classification Search ..... 182/82, 182/223

See application file for complete search history.

(56) References Cited

U.S. PATENT DOCUMENTS 4,444,289 A * 4/1984 Jungman ..... 182/36

FOREIGN PATENT DOCUMENTS

| | | |
|---|---|---|
| AU | 20771/92 | 10/1992 |
| DE | 4319664 | 2/1995 |
| FR | 1.528.135 | 6/1968 |
| JP | 2-274970 | 11/1990 |
| WO | WO 95/06794 | * 3/1995 |

* cited by examiner

*Primary Examiner*—Alvin Chin-Shue
(74) *Attorney, Agent, or Firm*—Christensen O'Connor Johnson Kindness PLLC

(57) ABSTRACT

A construction platform comprising a stationary support structure adapted to be fixedly secured to the floor of a building under construction and project from the edge of the building to a predetermined maximum extent, and a movable deck mounted on the stationary structure which may be extended as a cantilever therefrom or retracted into at least substantial registration therewith.

5 Claims, 7 Drawing Sheets

PARTLY RETRACTABLE CONSTRUCTION PLATFORM

CROSS-REFERENCE TO RELATED APPLICATIONS

The present application is a divisional of U.S. application Ser. No. 09/423,952, filed Jan. 14, 2000 now abandoned, which is the national phase of International Application No. PCT/AU/98/00359, filed May 15, 1998, the benefit of the filing dates of which is claimed under 35 U.S.C. § 120; which in turn claims the benefit of Australian Application No. PO6858, filed on May 16, 1997, the benefit of the filing date of which is hereby claimed under 35 U.S. § 119.

TECHNICAL FIELD

This invention relates to so called construction platforms. That is to say to temporary loading platforms, which, in use, project from the above ground floors of multi-storey buildings under construction, to act as landings for the receipt of loads of building material and the like deposited on the platform by a crane.

BACKGROUND

Construction platforms are widely used in the construction of reinforced concrete or steel framed buildings wherein the outer skin of the building is not load bearing, and is not put in place until after the main supporting structure of the building has been finished, and its major internal fittings have been installed.

Such construction platforms customarily comprise an inboard portion, which rests upon and is fixed to an edge margin of a building floor, and an outboard portion, including a landing deck, which extends as a cantilever from the inboard portion beyond the edge of the floor. Conveniently, the inboard portion may comprise a base frame adapted to rest on the floor and a plurality of extendible props rising from the base frame to the underside of the next higher floor whereby the base frame, and therefore the platform as a whole, is clamped in position.

Hitherto, construction platforms have fallen into two classes, namely fixed deck platforms and movable deck platforms. Fixed deck platforms have the inboard and outboard portions integrally united as a single structure. They are simple in design, robust and inexpensive compared to movable deck platforms. However they suffer from the disability that they project from the building during the whole of the construction period and require to be staggered in the vertical direction across a face (or faces) of the building so that higher platforms do not obstruct the rope of a crane depositing a load onto, or lifting a load from, a lower platform. This, in turn, requires the use of an expensive long reach crane, to service all of the platforms at the site, if the crane operates from a fixed location, as is usual.

Movable deck platforms, examples of which are shown in U.S. Pat. No. 4,444,289 (Jungman) and International Patent Application No. PCT/AU94/00509 (Preston) have the outboard portion movably mounted on the inboard portion, so that it may be retracted when not in use to leave the face of the building free of obstructions. This overcomes the mentioned disability of fixed deck platforms, but at the expense of a much more complicated and heavily built platform because of the need to provide a two part, telescoping base frame with sufficient overlap between the parts to enable the bending moment applied by the extended outboard part to the inboard part to be resisted. Further more the outboard part has to be heavily designed to give it appropriate rigidity as it derives little or no bracing effect from being clamped to the building floor. For these reasons, movable deck platforms have not been widely adopted by comparison with fixed deck platforms.

The present invention arose from the simple appreciation that a crane rope must extend through the center of gravity of the load, and is thus necessarily spaced from the face of a building when lifting or lowering a load beside the building. Thus a degree of permanent projection of a higher platform is not objectionable, in that it will not interfere with the deposition of a load onto a lower platform even though it be directly underneath the higher platform.

SUMMARY OF INVENTION

In a first aspect the present invention consists in a construction platform comprising a stationary support structure adapted to be fixedly secured to the floor of a building under construction and project from the edge of the building to a predetermined maximum extent, and a movable deck mounted on the stationary support structure which may be extended as a cantilever therefrom or retracted into at least substantial registration therewith.

Preferably said support structure includes two substantially parallel transverse spaced guide beams, and two pairs of length adjustable struts respectively associated with the guide beams and projecting upwardly therefrom, and wherein in each pair of struts, the strut closest to the edge of the building is located at or near the location on the support structure where the uplifting force of said movable deck is reacting when said movable deck is an in-use extended position.

Preferably the stationary support structure projects from the edge of the building to a predetermined maximum extent of no more than about two and a half meters, and more preferably to a predetermined maximum extent of about one and a half meters.

Preferably an abutment means projects from the underside of said stationary support structure at one end thereof, and in-use said abutment means is adapted to contact the edge of said floor of the building to ensure that said stationary support structure projects from the edge of the building to said predetermined maximum extent.

Preferably said support structure includes two substantially parallel transversely spaced I-beams, and said movable deck includes two smaller substantially parallel transversely spaced I-beams, each of said smaller I-beams of said movable deck is at least partially nested within the flanges of a respective I-beam of said support structure and adapted for movement therealong.

Preferably at least one first roller is rotatably connected to each I-beam of said support structure, and said first roller is adapted to run between two flanges of the respective smaller I-beam of said movable deck.

Preferably at least one second roller is rotatably connected to each smaller I-beam of said movable deck, and said second roller is adapted to run between two flanges of the respective I-beam of said support structure.

In a second aspect the present invention consists in a hybrid construction platform including a stationary inboard portion adapted to project from a building edge to a predetermined maximum extent of no more than two meters, and a movable portion mounted on the stationary portion which may be extended as a cantilever therefrom or retracted into at least substantial registration therewith.

Preferably an abutment means projects from the underside of said stationary inboard portion at one end thereof, and in-use said abutment means is adapted to contact said edge of the building to ensure that said stationary inboard portion projects from the edge of the building to said predetermined maximum extent.

Preferably the stationary inboard portion is adapted to project from the building edge to a predetermined maximum extent of about one and a half meters.

While effectively retaining the benefits of movable deck platforms generally, substantial further advantages flow from this hybrid construction by comparison with prior known fully retractable movable deck platforms of comparable deck area. For example, the movable portion may be more lightly constructed in that its cantilevered length is reduced and the reaction points between the movable portion and the stationary portion may be more widely spaced in the direction of movement, resulting in considerable reduction in the mass of the moving portion and in consequent ease of movement. Lateral bracing for the stationary portion may be positioned underneath its outboard part in the plane of the building floor. This enables the movable portion to be positioned nearer to the floor surface, with consequent reduction in ramping height for fork lift truck and the like driving onto and off the movable portion.

BRIEF DESCRIPTION OF THE DRAWINGS

By way of example, an embodiment of the above described invention is described more fully hereinafter with reference to the accompanying drawings.

MODE OF CARRYING OUT INVENTION

Figure 2:
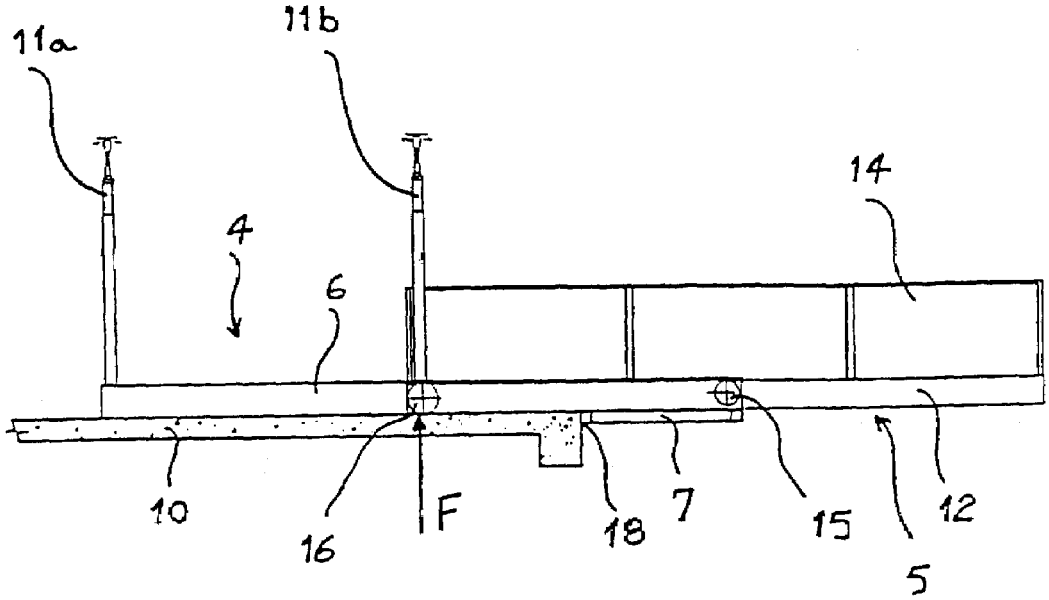
FIG. 2 is a view similar to FIG. 1 of the platform of that figure in its extended configuration.

The first and second embodiments of the platforms shown in FIGS. 1 to 4 each comprise a stationary support structure 4, and a movable deck portion 5 adapted to move between a retracted configuration and an in-use extended configuration. The only difference between the two embodiments is that the movable deck 5 of the first embodiment extends to a further extent than that of the movable deck in the second embodiment. The first and second embodiments have similar components, and like reference numerals are use for both embodiments.

In each embodiment, a stationary support structure 4 comprises two, spaced apart, substantially parallel, rolled steel joists (guide beams) 6. Those joists may be channel sectioned, but preferably are conventional I beams, comprising a central upright web and substantially horizontal, upper and lower flanges. The joists 6 are united into a base frame for the stationary portion 4 by at least a cross member (not shown) extending from one to the other at or near their inboard ends, and by a ladder frame 7, comprising stiles 8 and rungs 9. In accordance with one feature of the present invention the ladder frame 7 is fixed to the under sides of the lower flanges of the joist 6, so that the frame lies in substantially the same plane as that of a building floor 10 on which the joists 6 may rest. For preference all of the components of the stationary support structure 4 referred to above are welded together to form a rigid, unitary frame.

Figure 1:
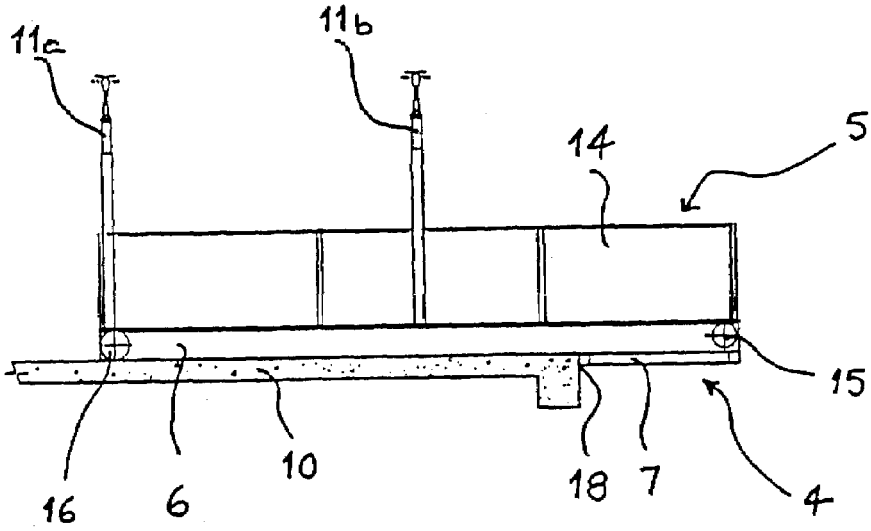
FIG. 1 is a diagrammatic side elevation of a first embodiment of a construction platform according to the invention in its retracted configuration.
Figure 3:
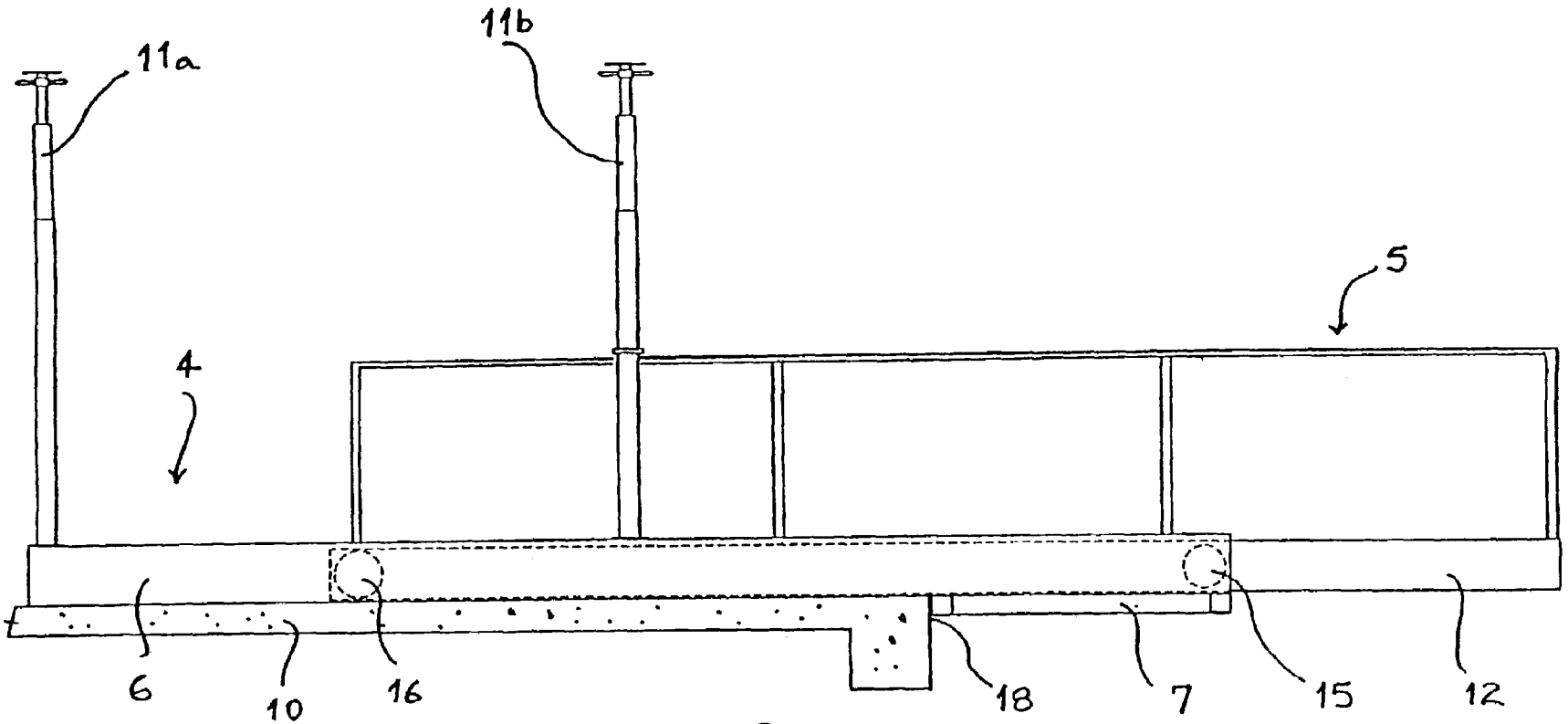
FIG. 3 is a diagrammatic side elevation of a second embodiment of a construction platform according to the invention in its extended configuration.
Figure 4:
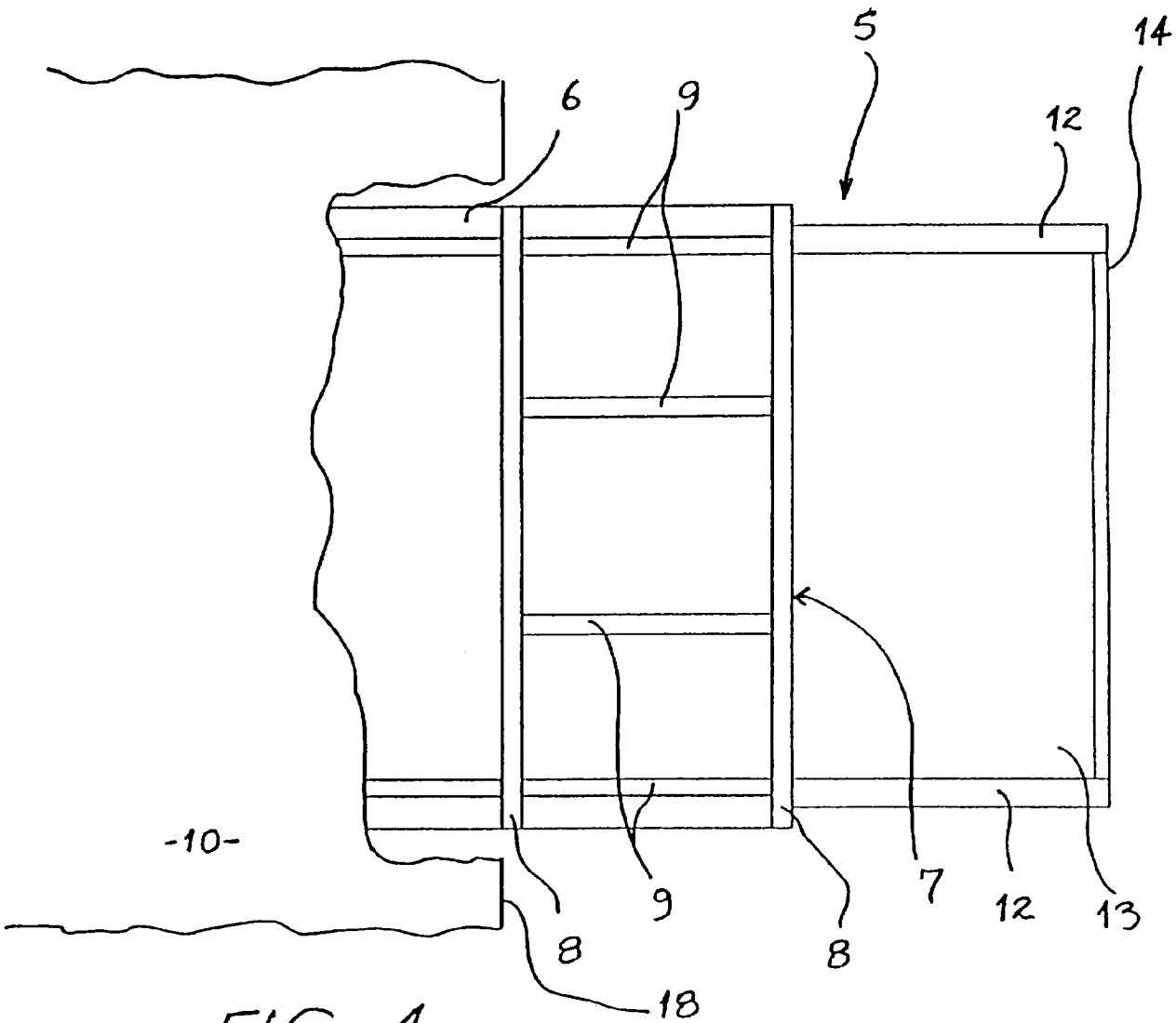
FIG. 4 is a view from below the platform of FIG. 3 with part of the building floor cut away.

The stationary support structure 4 is held fixedly in place by four (two pairs of) extendible props (or struts), each pair of props 11*a*,11*b* are associated with each joist 6. Only one pair of props 11*a*,11*b* are shown in FIGS. 1–3. Those props may be hydraulic cylinders, but preferably are in the nature of telescopic screw jacks. They may abut a next higher floor (not shown) and serve to clamp the stationary support structure 4 firmly in position.

It should be noted that the ladder frame 7 serves as a locating abutment for the stationary support structure 4. When it contacts the edge 18 of the floor 10, then the stationary support structure 4 is projecting (cantilevered) from the floor to the designed extent, which is preferably about one and a half meters. That figure has been selected after considerable research and observation as to the minimum distance by which crane drivers normally space the crane rope from a building at the time of depositing a load on fixed platforms. However, it should be understood that the designed extent to which the stationary support structure projects may be up to two and a half meters.

The movable deck portion 5 comprises two further rolled steel joists 12, somewhat smaller in cross-section than the joists 6, a deck 13, and safety perimetral barriers 14 extending along the side edges and end edge of the deck 13.

Figure 5:
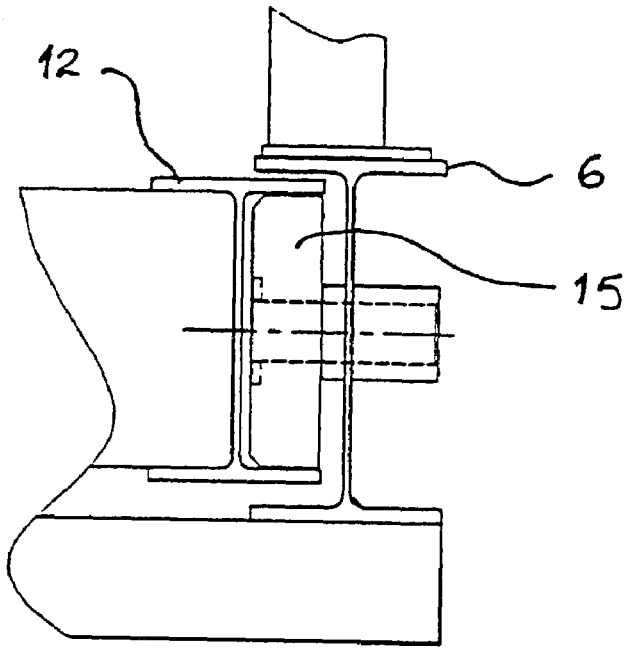
FIG. 5 is an enlarged schematic of the joist/roller nesting arrangement of the smaller roller wheel which may be used with either of the first or second embodiments of the construction platform shown in FIGS. 1 to 4.
Figure 6:
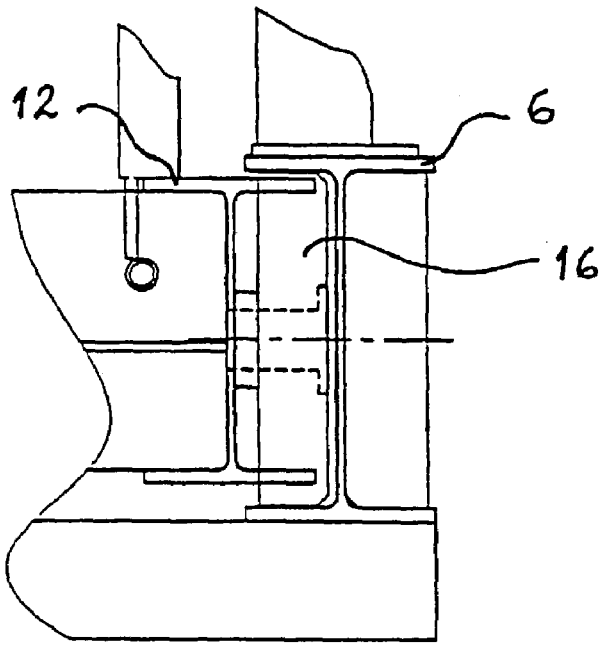
FIG. 6 is enlarged schematic of the joist/roller nesting arrangement of the larger roller wheel which may be used with either of the first or second embodiments of the construction platform shown in FIGS. 1 to 4.

The joists 12 may also be I beams and their flanges are nested between the flanges of the joist 6 to be telescopically movable therein. Such movement may be facilitated by rollers 15 mounted for rotation upon the joist 6 for engagement with the flanges of the joists 12, and rollers 16 mounted for rotation upon the joists 12 for engagement with the flanges of the joists 6, as shown in FIGS. 5 and 6.

By nesting the flanges of joists 12 and 6, and running rollers 15 and 16 in contact with the flanges, a smooth movement of the movable deck portion 5 with respect to the support structure 4 is achieved, and reduces the possibility of picking up debris. In order to allow ease of running of the rollers 15 and 16 along the flanges, a small gap (not shown) may preferably be provided between each roller and the respective flanges it rolls along.

In each pair of props 11*a*,11*b*, the props 11*a* are located at the inboard end of stationary support structure 4, whilst the props 11*b* are located on the stationary support structure 4, preferably in line with or near where the uplifting force F of the movable deck 5 is reacting, when the deck 5 is an in-use extended position as shown in FIG. 2.

In use, as a result of the partly cantilevered stationary support structure 4, the pivoting point of the movable deck 5 is able to extend further out from the edge of the building, than can be achieved with prior art movable deck platforms.

Figure 7:
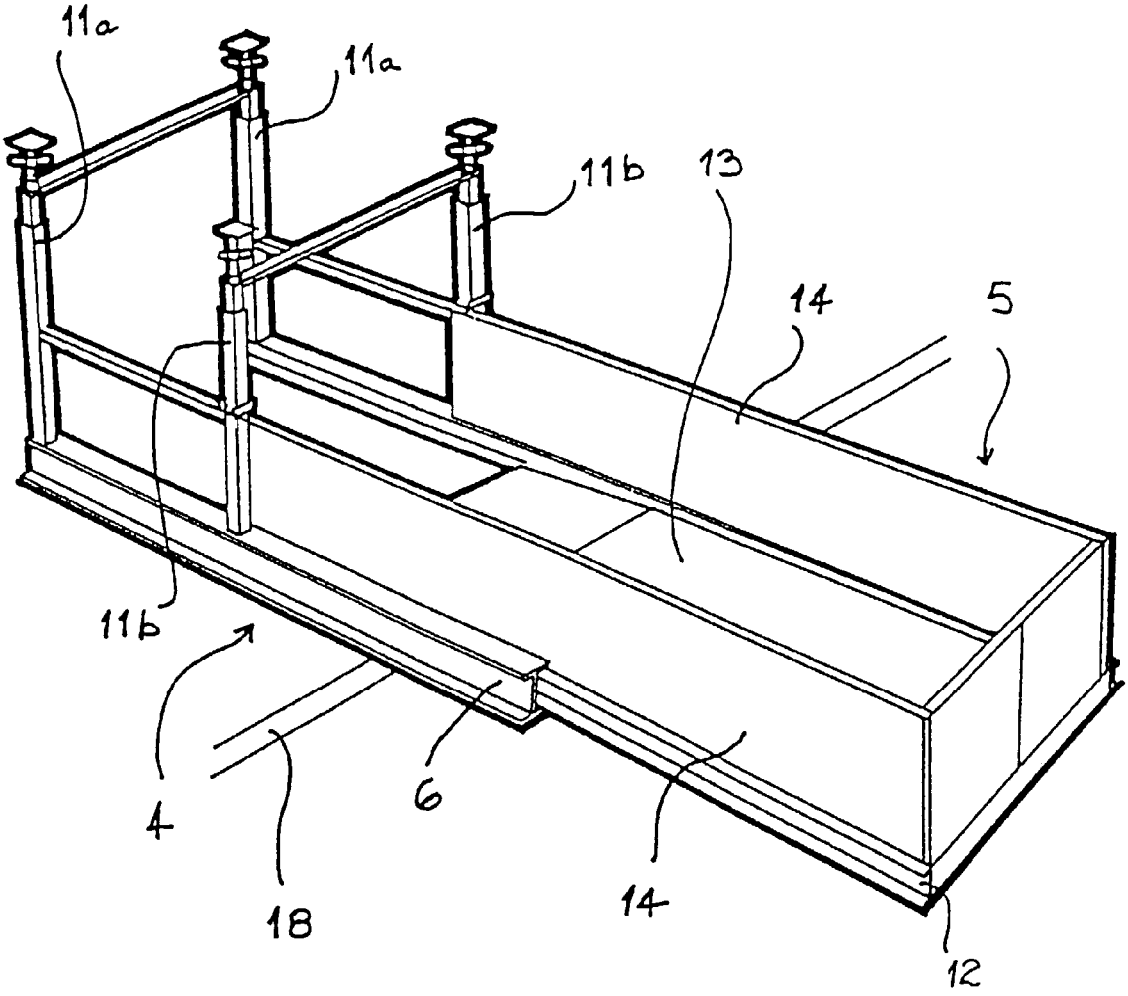
FIG. 7 is a perspective view of a third embodiment of a construction platform according to the invention.
Figure 8:
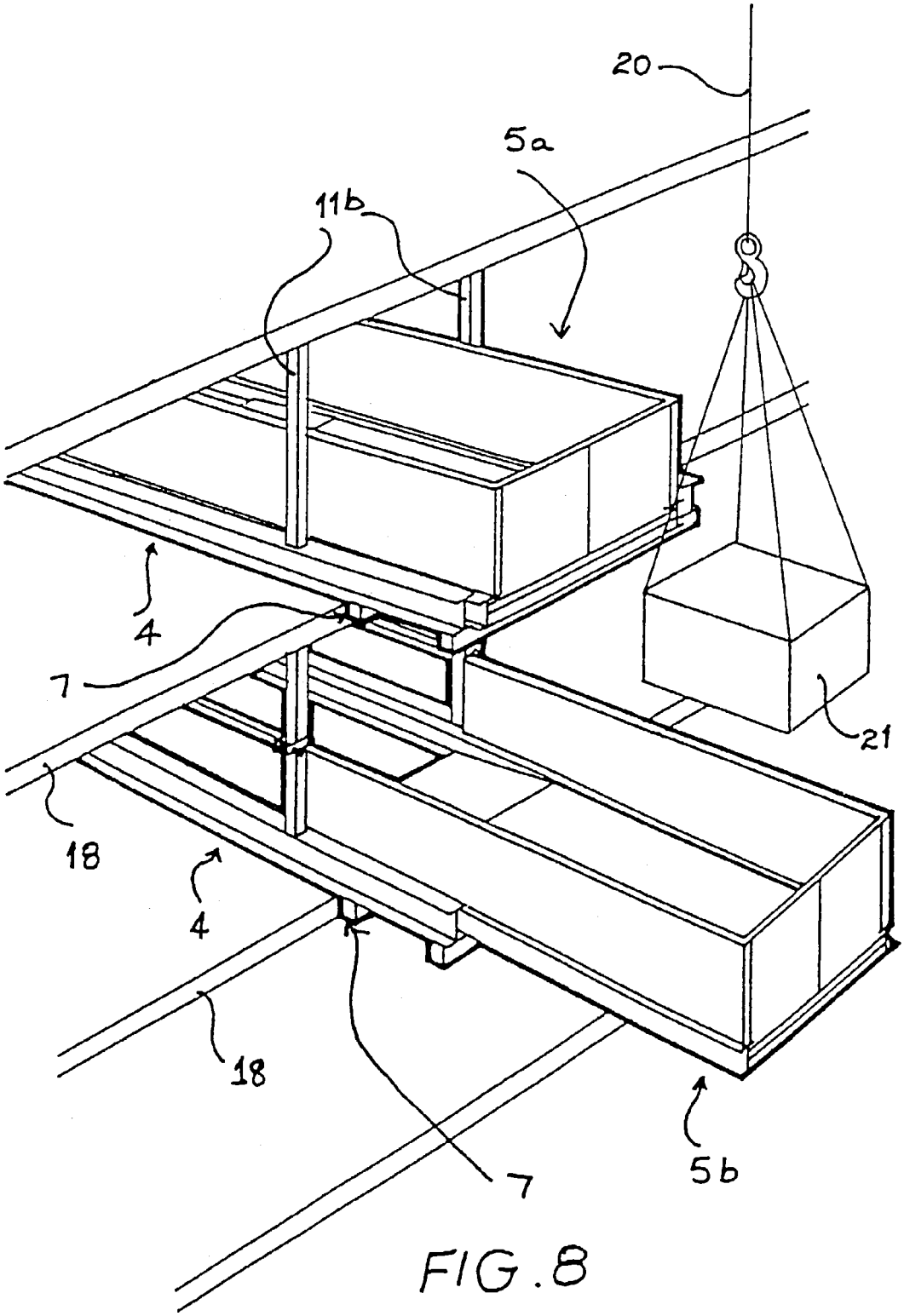
FIG. 8 is a perspective view of two construction platforms of the type shown in FIG. 7 secured to a building under construction.
Figure 9:
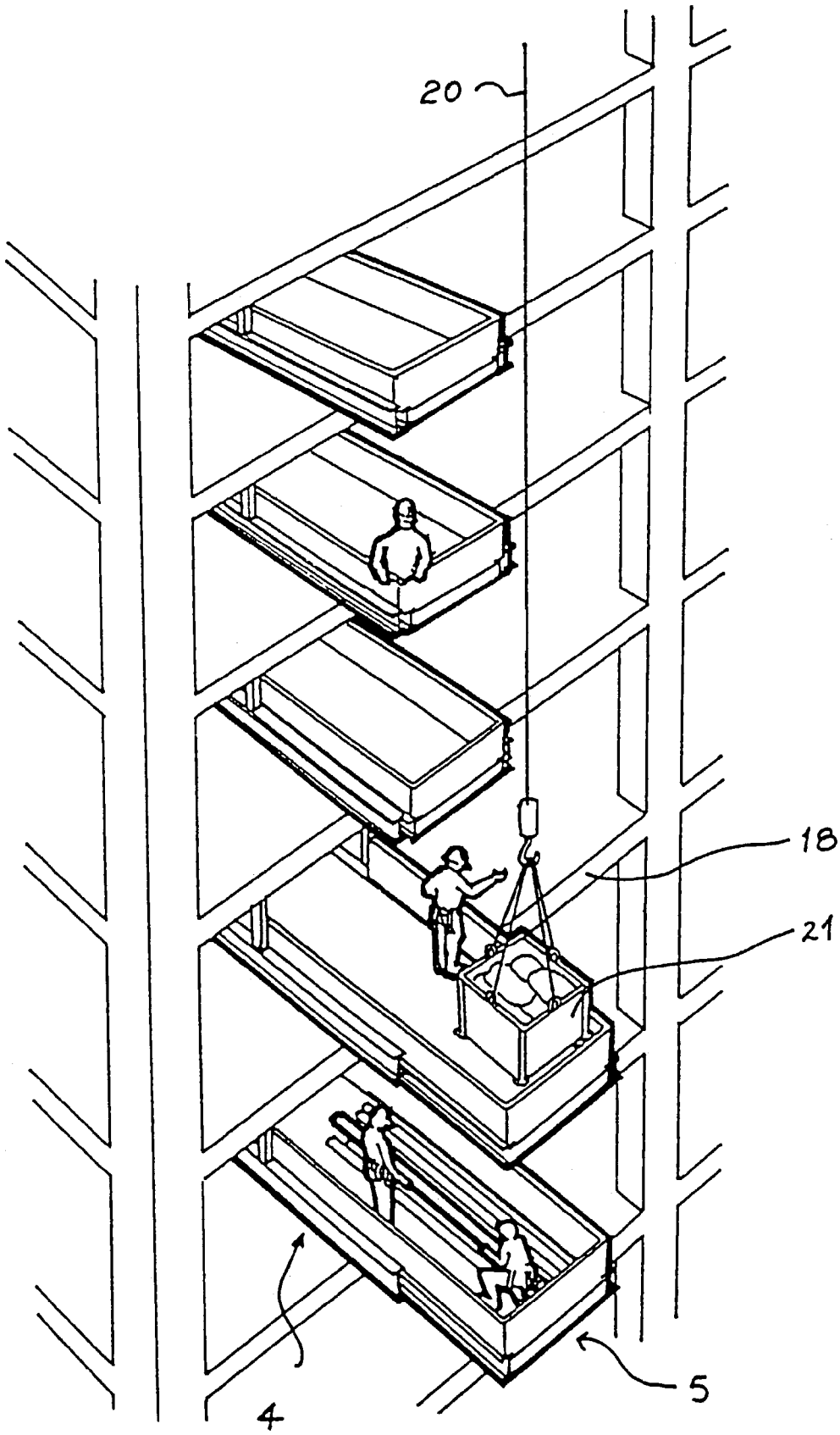
FIG. 9 is a perspective view of a number of construction platforms of the type shown in FIG. 7 secured to a building under construction.

FIGS. 7 to 9 show a third embodiment of a construction platform according to the invention. FIG. 8 shows two construction platforms fixed to respective adjacent floors of a building under construction. Both platforms have their stationary support structures 4 cantilevered to a predetermined maximum extent of about one and a half meters from the edge of the building 18, and positioned to this predetermined maximum extent by the ladder frames 7 which act as locating abutments. The higher platform having its movable deck portion 5*a* in a retracted position, whilst the lower platform has its movable deck portion 5*b* in an in-use extended position. A crane rope 20 is able to lower and lift a load 21 to and from the lower platform without interfering with the upper platform.

It should be readily understood by those skilled in the art that various modifications may be made to the construction platforms as described above without departing from the spirit and scope of the invention. For instance, the number and location of props (or struts) on the stationary support structure may differ from those shown in the above mentioned embodiments.

The invention claimed is:

1. A method of depositing a load on a first construction platform fixedly secured to a floor of a multi-story building under construction, said first construction platform having a first deck located beneath at least one second construction platform fixedly secured to a higher floor, said second construction platform being a partly retractable construction platform comprising a stationary support structure projecting outwardly from an edge of the building to a predetermined maximum extent, and a movable deck mounted on said stationary support structure which may be extended as a cantilever therefrom beyond said predetermined maximum extent or retracted into substantial registration therewith, said first deck of said first construction platform being located directly beneath the movable deck of said at least one second construction platform when said movable deck is extended as a cantilever, and said load is supported by a crane rope above said movable deck when said movable deck is extended as a cantilever, the method comprises the steps of:

(a) retracting said movable deck into substantial registration with said stationary support structure; and (b) lowering the crane rope such that said load passes said stationary support structure of said at least one second construction platform beyond said predetermined maximum extent without interference therewith and depositing the load on said first deck.

2. A method of depositing a load on a first constructions platform fixedly secured to a floor of a multi-story building under construction as claimed in claim 1, wherein said at least one second construction platform is a plurality of partly retractable platforms, located at respective spaced apart floors at locations higher than said first construction platform.

3. A method of depositing a load on a first construction platform fixedly secured to a floor of a multi-story building under construction as claimed in claim 1 wherein said predetermined maximum extent is no more than two and half meters.

4. A method of depositing a load on a first construction platform fixedly secured to a floor of a multi-story building under construction as claimed in claim 1, wherein said predetermined maximum extent is no more than one and a half meters.

5. A method of depositing a load on a first construction platform fixedly secured to a floor of a multi-story building under construction, said first construction platform having a first deck located beneath a plurality of second construction platforms fixedly secured to respective higher floors, each of said second construction platforms being a partly retractable construction platform comprising a stationary support structure projecting outwardly from an edge of the building to a predetermined maximum extent, and a movable deck mounted on said stationary support structure which may be extended as a cantilever therefrom beyond said predetermined maximum extent or retracted into substantial registration therewith, said first deck of said first construction platform being located beneath the movable decks of said second construction platforms when said movable decks are extended as cantilevers, and said load is supported by a crane rope above said movable decks when said movable deck are extended as cantilevers, the method comprises the steps of:

(a) retracting each movable deck into substantial registration with its respective stationary support structure; and (b) lowering the crane rope such that said load passes the stationary support structures of the plurality of second construction platforms beyond said predetermined maximum extent without interference therewith and depositing the load on said first deck.

* * * * *

UNITED STATES PATENT AND TRADEMARK OFFICE

CERTIFICATE OF CORRECTION

PATENT NO. : 7,070,020 B2
APPLICATION NO. : 10/273813
DATED : July 4, 2006
INVENTOR(S) : J.C. Preston It is certified that error appears in the above-identified patent and that said Letters Patent is hereby corrected as shown below:

| COLUMN | LINE | |
|---|---|---|
| (30) Pg. 1, col. 1 | Foreign Application Priority Data | insert in appropriate order --(30) **Foreign Application Priority Data** May 16, 1997 (AU) PO 6858-- |
| 6 (Claim 2, | 3 line 1) | "constructions" should read --construction-- |

Signed and Sealed this

Twenty-sixth Day of December, 2006

JON W. DUDAS
*Director of the United States Patent and Trademark Office*